US007574957B2

(12) United States Patent
Baumgarten et al.

(10) Patent No.: US 7,574,957 B2
(45) Date of Patent: Aug. 18, 2009

(54) WEAR DETECTOR FOR INK FOUNTAIN FILMS

(75) Inventors: Sven Baumgarten, Neckargemünd (DE); Martin Mayer, Ladenburg (DE); Bernhard Roskosch, Wiesloch (DE); Rolf Spilger, Viernheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 71 days.

(21) Appl. No.: 11/606,254

(22) Filed: Nov. 29, 2006

(65) Prior Publication Data

US 2007/0131125 A1 Jun. 14, 2007

(30) Foreign Application Priority Data

Dec. 12, 2005 (DE) ..... 10 2005 059 156

(51) Int. Cl.
*B41F 1/46* (2006.01)

(52) U.S. Cl. ..... 101/365; 101/483; 101/DIG. 47

(58) Field of Classification Search ..... None
See application file for complete search history.

(56) References Cited

U.S. PATENT DOCUMENTS

| | | | | | |
|---|---|---|---|---|---|
| 3,702,587 | A | * | 11/1972 | Lee | 101/207 |
| 3,930,447 | A | * | 1/1976 | Murray | 101/365 |
| 4,193,345 | A | * | 3/1980 | Schoneberger et al. | 101/365 |
| 4,369,706 | A | * | 1/1983 | Forster et al. | 101/365 |
| 4,372,207 | A | | 2/1983 | Toyoda | |
| 4,381,708 | A | | 5/1983 | Hirt et al. | |
| 4,387,648 | A | | 6/1983 | Jeschke et al. | |
| 4,495,864 | A | | 1/1985 | Junghans | |
| 4,570,539 | A | * | 2/1986 | Rottstedt | 101/483 |
| 4,803,923 | A | * | 2/1989 | Kenichi | 101/365 |
| 5,052,297 | A | * | 10/1991 | Albiez | 101/365 |
| 6,634,293 | B2 | | 10/2003 | Hofheinz et al. | |

FOREIGN PATENT DOCUMENTS

| | | | |
|---|---|---|---|
| DE | 29 23 678 | A1 | 12/1980 |
| DE | 29 35 489 | A1 | 3/1981 |
| DE | 31 41 990 | A1 | 9/1982 |
| DE | 32 03 500 | A1 | 8/1983 |
| DE | 37 27 656 | A1 | 3/1989 |
| DE | 197 32 249 | A1 | 1/1999 |
| DE | 101 03 842 | A1 | 10/2001 |
| DE | 100 55 827 | A1 | 5/2002 |

* cited by examiner

*Primary Examiner*—Jill E. Culler
(74) *Attorney, Agent, or Firm*—Laurence A. Greenberg; Werner H. Stemer; Ralph E. Locher

(57) ABSTRACT

A device for determining the wear of ink fountain films in an ink fountain has at least one ink metering element and a ductor in a printing press. The ink metering element can be moved in the direction of the ductor. A closed position of the ink metering element with an ink fountain film inserted can be determined, and that deviations from the closed position determined are registered by a sensor and the deviations registered can be supplied to a computer as a basis for determining the wear of the ink fountain film.

12 Claims, 5 Drawing Sheets

WEAR DETECTOR FOR INK FOUNTAIN FILMS

CROSS-REFERENCE TO RELATED APPLICATION

This application claims the priority, under 35 U.S.C. §119, of German application DE 10 2005 059 156.6, filed Dec. 12, 2005; the prior application is herewith incorporated by reference in its entirety.

BACKGROUND OF THE INVENTION

Field of the Invention

The invention relates to a device for determining the wear of ink fountain films in an ink fountain having at least one ink metering element and a ductor in a printing press.

Offset printing presses for high quality printing have an ink fountain in the printing units for metering the printing ink, which ink fountain is subdivided into a plurality of inking zones, so that individual inking zones can be set separately over the entire width of the printing material. In this case, the ink is transported out of the ink fountain by a ductor roller, which rotates in the ink fountain and thus picks up ink continuously. In order to be able to set the ink build-up on the ductor roller for each inking zone, there are ink metering elements such as inking zone slides in the individual inking zones of the inking fountain, in order in this way to be able to vary the application of ink on the ductor roller zonally. The inking zone slides are mounted in a frame and can be moved in the direction of the ink ductor roller and are normally driven by electric motors. In the closed position, the frame and the ink metering elements would touch the ink ductor roller and damage the latter as a result of the lasting mechanical friction. For this reason, between the ink ductor roller and ink metering elements there is an ink fountain film, so that ink metering elements and the frame and the ink ductor roll cannot rub on one another mechanically but are separated by the ink fountain film. The ink fountain film itself represents a wearing part and hitherto had to be replaced at regular intervals or following a visual inspection by the operating personnel of the printing press.

Published, non-prosecuted German patent application DE 197 32 249 A1 discloses a method and a device for positioning an actuating element in the printing press. Metering elements in an ink metering device which can be moved against a ductor or a metering roller are named explicitly as such an actuating element. In this case, it is a matter of registering the zero position of such a metering element, that is to say that position in which the metering element is just striking the ductor roller. The zero position is then stored as a comparative position for further positioning operations, so that the drive actuating the metering element always has the zero position stored as a comparative value when opening and closing the metering element. Depending on the zero position determined, all the movement steps are then calculated from this time on and are executed as a function of the zero position. The change resulting in comparison with the zero position during the actuation of the metering element is additionally registered by a sensor, so that the current position of the metering element results from the stored zero position and the value registered by the sensor. This method and this device have the disadvantage that the wear on the metering elements is not taken into account. Consequently, with the method and the device in published, non-prosecuted German patent application DE 197 32 249 A1, the wear of an ink fountain film in the inking unit of a printing press cannot be determined either.

In order to prevent damage to the ductor roller in the inking unit of an offset printing press, it is necessary, however, to take the wear of the ink fountain film into account since, after a certain operating time, the ink fountain film has been worn through, so that the ink metering elements and the frame strike the ductor roller and then damage the latter. Such damage can be avoided, according to the prior art, only by a visual inspection by the operating personnel.

SUMMARY OF THE INVENTION

It is accordingly an object of the invention to provide a wear detector for ink fountain films which overcomes the above-mentioned disadvantages of the prior art devices of this general type, which permits the wear of ink fountain films to be registered during the operation of a printing press.

With the foregoing and other objects in view there is provided, in accordance with the invention, a device for determining wear of ink fountain films in an ink fountain. The device includes a sensor, a computer connected to the sensor, at least one ink metering element, and a ductor. The ductor and the ink metering element are disposed in a printing press. The ink metering element can be moved in a direction of the ductor. A closed position of the ink metering element with an ink fountain film inserted can be determined, and deviations from the closed position being determined and registered by the sensor. The deviations registered are supplied to the computer as a basis for determining the wear of the ink fountain film.

With the present invention, it is possible for the first time to register the wear of an ink fountain film during the operation of a printing press. The invention can be employed in all offset printing presses having ink fountains in which zonal ink metering is carried out by ink metering elements operating against a ductor roller. Between the ductor roller and ink metering elements there is a replaceable ink fountain film, in order to avoid damage to the ink doctor roller and the ink metering elements. The ink metering elements can be moved in the direction of the ductor by an electric, hydraulic or pneumatic drive, so that the distance between ink metering elements and ink ductor can be set as desired by the drive. When the ink fountain film is located in the ink fountain, the distance between the ink fountain film and ink ductor can also be determined by the drive element. The wear of the ink fountain film can be read off by using the remaining thickness of the film. If the thickness of the ink fountain film falls below a permissible amount, it counts as used, since there is then the risk that the ink fountain film will wear through and in this way ink ductor and ink metering elements can come directly into contact. In order to register the thickness of the ink fountain film, first the closed position of the one or of the plurality of ink metering elements is determined with the ink fountain film inserted. To this end, at least one metering element is closed until it is just pressing the film against the ductor roller. This position of the ink metering element is called the closed position. The closed position determined in this way is registered by a sensor and stored on a computer of the printing press. During the operation of the printing press, the closed position is then monitored continuously, so that deviations from the stored closed position can be registered.

If the deviations from the closed position determined at first exceed a permitted amount, it can be assumed that the ink fountain film has suffered excessive abrasion in accordance with the deviations, and has thus reached the dangerous region. It is therefore possible for the sensor to monitor the remaining thickness and thus the wear of the ink fountain film continuously during the operation of the printing press. The operating personnel therefore no longer have to carry out a visual inspection in the ink fountain at regular intervals in order to monitor whether the ink fountain film still has sufficient material. In addition, in the case of a defective ink fountain film which, because of a lower quality, wears more quickly than generally usual, a collision of the ink metering element with the ductor can be prevented. The present invention thus permits reliable and mechanical monitoring of the wear of the ink fountain film.

In a first refinement of the invention, provision is made for the deviations from the closed position, registered by the sensor, to be compared in the computer with the thickness of the ink fountain film. The thickness of the ink fountain film in the new state is known by the manufacturer and is normally of the order of magnitude of 190 μm. This thickness is entered into the computer of the machine and is thus known to the system. Thereafter, the determination of the closed position is carried out once by the ink fountain elements being closed, bearing on the ink fountain film. From that time on, during continuous operation, the deviations from the closed position stored once are determined and these deviations are then used as a measure for the thickness of the ink fountain film that still remains. For this purpose, a still permissible minimum thickness of the ink fountain film can be stored in the computer, so that when the ink fountain film thickness falls below the still permissible ink fountain film thickness, no longer permissible wear of the ink fountain film is detected. The deviations from the closed position determined once are therefore set equal to the still remaining thickness of the ink fountain film.

Provision is additionally made for it to be possible to display the deviations from the closed position, registered by the sensor, on a display device as the current thickness of the ink fountain film. Modern printing presses are controlled via operating desks having monitors, via which the entries to the machine control system of the printing press are possible. By using these entries, the ink metering elements in the ink fountain of a printing press can also be adjusted by the printer. The monitor which is present in any case for the operation of the printing press can also be used for the purpose of displaying on the monitor the deviations determined by the sensor as the remaining residual thickness of the ink fountain film. In this way, the operating personnel can always have the wear of the ink fountain film in view, it also being possible for the color displayed on the monitor to change as a function of the still remaining residual thickness. In the new state, the film can be displayed in a green color, for example, while in the case of a moderate still reminding thickness, the ink fountain film appears yellow. As soon as the ink fountain film approaches the just still permissible minimum, the ink fountain film will appear in a red color. Therefore, the manner in which the state of the ink fountain film changes in relation to wear is also signaled visually to the operating personnel.

In a particularly advantageous refinement of the invention, provision is made that when the thickness of the ink fountain film falls below a predefined value, a warning signal is generated. In addition to or instead of the visual display of the state of the ink fountain film on a monitor, an acoustic or additional visual warning signal in the form of a flashing light can also be output when the thickness of the ink fountain film has fallen below the minimum permissible. An acoustic warning signal has the advantage that the operating personnel are informed about the state of the ink fountain film even if they are not within the visual range of the monitor but, for example, are carrying out maintenance work or changeover work on a remote part of the printing press.

Provision is advantageously additionally made that, in order to determine the current thickness of the ink fountain film, the course of the motor current of an electric drive for moving the ink metering element is determined. The closed position in the case of a new ink fountain film, and also the deviations occurring thereafter on account of the wear of the film, can be determined first by a separate distance sensor, which continuously registers the thickness of the ink fountain film. Alternatively or additionally, however, this can also be done by registering the motor current of the normally electric drive of the ink metering elements. When an ink metering element driven by an electric motor is moved against the ductor, at the moment when it presses the metering element having the ink fountain film against the ductor, the motor needs an increased motor current. This increase in the motor current is used as a clue for the closed position. The course of the motor current depending on time and actuating travel, including the current peak as a result of the increase in the motor current, can in this case be stored on the computer of the printing press. When the ink fountain film wears, the increase in the motor current will occur at a different point on the actuating travel. By a comparison of the increase in current occurring in the case of a newly inserted ink fountain film and the increase in current occurring during operation, it is possible to draw conclusions about deviations from the original closed position, which then in turn permit conclusions to be drawn correspondingly about the decreasing thickness of the ink fountain film. Thus, via the course of the motor current, the current closed position can be compared with the original closed position and the current thickness of the ink fountain film can thus be determined.

Provision is additionally made for there to be a plurality of inking zones with a plurality of ink metering elements and for it to be possible to determine the current thickness of the ink fountain film separately for each of these inking zones. In this case, each ink metering element is monitored by a sensor, so that the thickness of the ink fountain film is determined over the entire width in all the inking zones. This has the advantage that different local wear of the ink fountain film can be registered, it then being possible to select as a measure that inking zone which exhibits the currently lowest still remaining residual thickness of the ink fountain film. When the inking zone then falls below the permitted minimum, the warning signal is output, so that the ink fountain film is replaced in good time. As compared with the solution with only one or a few sensors, it is therefore ensured that even locally disproportionately high wear of the ink fountain film is determined in good time, so that none of the ink metering elements wears through the ink fountain film in any inking zone and is able to strike the ink ductor.

Furthermore, in order to register the closing point of the ink metering element, provision is made for the torque of the drive motor to be registered when the ink metering element is closed. In addition to the separate thickness sensor or the sensor for registering the motor current as a measure for the still remaining thickness of the ink fountain film, the closing point of the ink metering element can also be registered by registering the torque of the drive motor. As soon as the ink metering element having the ink fountain film makes contact with the ductor roller in the closed position, an increase in the torque arises in the drive motor. This increase in torque over the actuating travel covered can be stored as a data set on the computer of the printing press. When the thickness of the ink fountain film decreases, this increase in torque will change over the actuating travel covered by the ink metering element. In this way, a deviating torque curve is obtained as a result of the wear of the ink fountain film. By the comparison of the original torque curve when registering the closing point of the ink metering element in the unused state of the ink fountain film and the deviations occurring during operation, it is possible to draw conclusions about the still remaining thickness of the ink fountain film in an analogous way. The ink fountain film wear can also be detected in this way.

Furthermore, it is alternatively or additionally possible for the rotational speed of the drive motor to be registered in order to register the closing point of the ink metering element. Via the rotational speed of the motor, the speed curve and, derived from the latter, the travel during the adjustment of the ink metering elements can be determined. As soon as the ink metering element strikes the ductor as it is being closed, the motor rotational speed decreases, since an increased resistance occurs. The closing point has thus been reached. This speed curve may be output to the computer by the rotational speed sensor present in most electric motors. In this case, no additional sensor is necessary, so that the result is a particularly economical solution.

Additionally, provision is made for the metering gap between the ink metering element and the ink ductor additionally to be adjustable by an adjusting element. The ink metering element is normally spring-mounted, so that even when the ink metering element strikes the ductor, a specific force is not exceeded, in order to avoid severe damage. In order to be able to shorten or lengthen the actuating travel of the ink metering element, the adjusting element is provided, with which the ink metering element, in its end position in the open state, can be positioned closer to or further away from the ductor. Such an adjusting element can constitute a screw, for example, which can be set in accordance with the desired distance.

Advantageously, the registration of the position of the ink metering element can also be used to register the position of the ink fountain. The ink fountain is configured such that it can be folded away for the purpose of cleaning and, during printing operation, must be set against the ink ductor. In the folded-away position, the distance from the ink metering element to the ink ductor increases, that is to say the ink metering element can be moved in the direction of the ink ductor beyond the closed position. If the ink metering element can be moved beyond the closed position, then this is a clear signal that the ink fountain has been folded away. In this position, it is not possible to print, so that a warning signal is output or the printing operation is automatically blocked as long as the ink fountain is folded away.

Other features which are considered as characteristic for the invention are set forth in the appended claims.

Although the invention is illustrated and described herein as embodied in a wear detector for ink fountain films, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
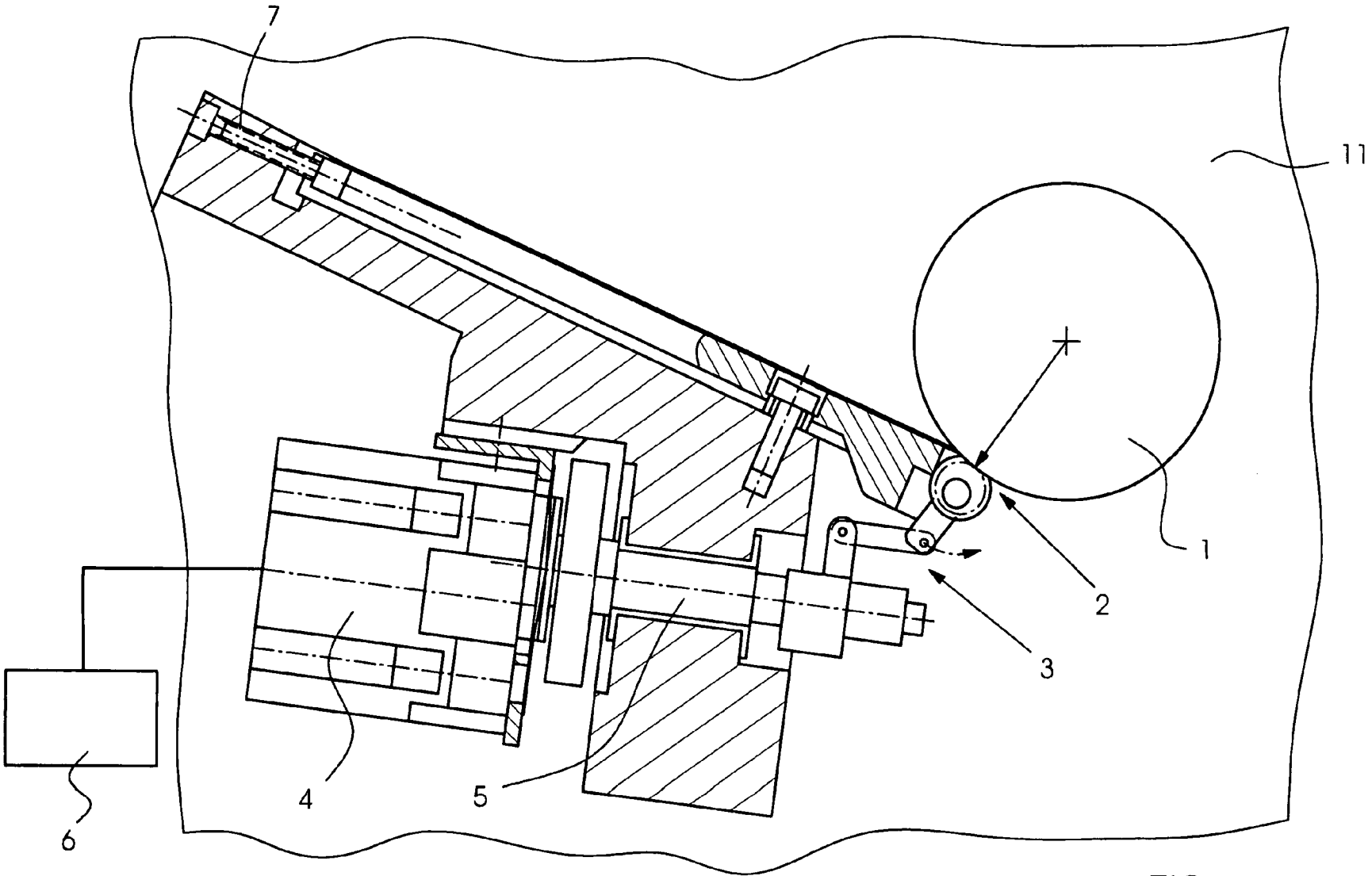
FIG. 1 is a diagrammatic, detailed sectional view of an ink fountain having an ink ductor and an-ink metering element according to the invention.
Figure 4:
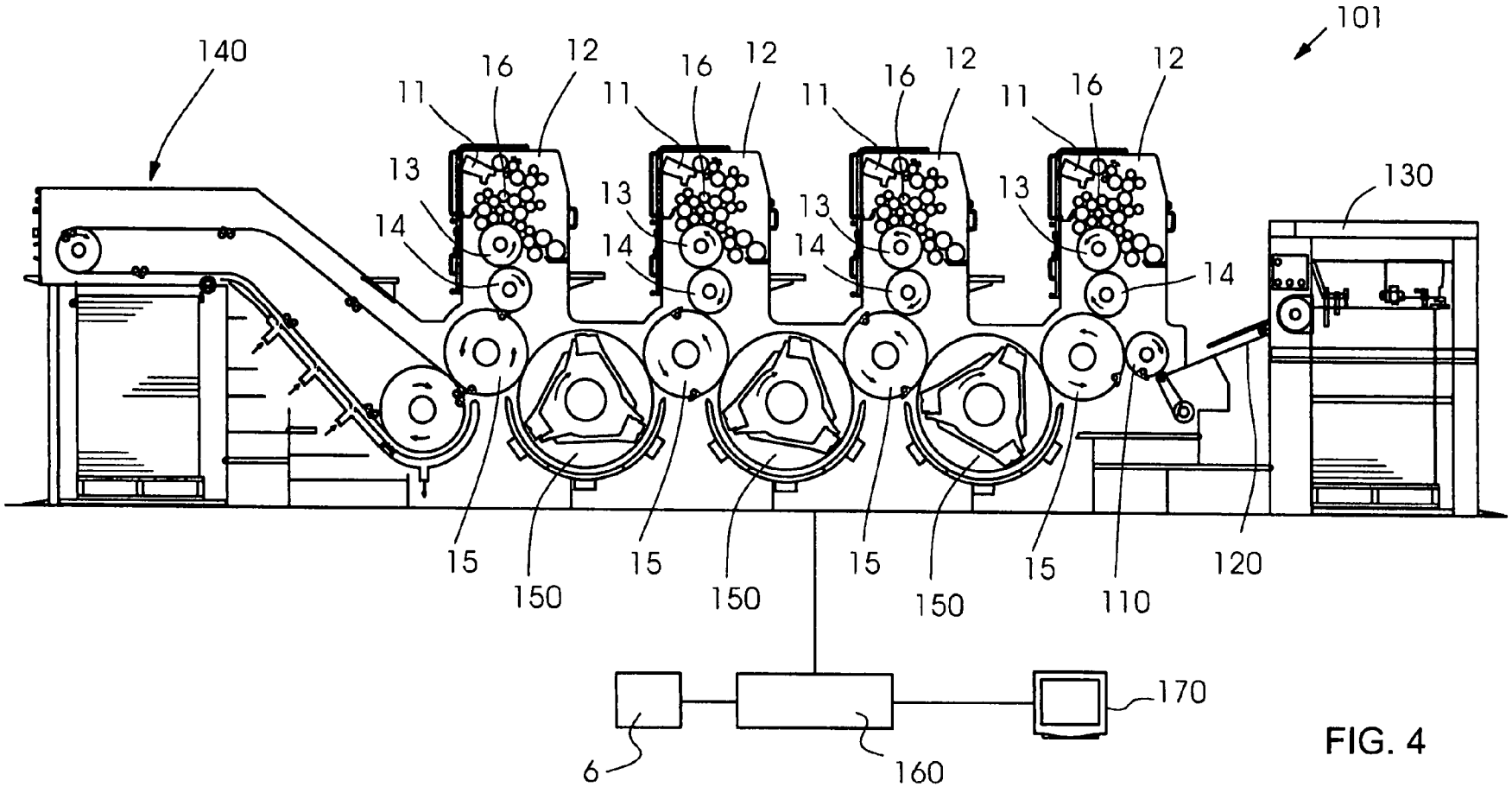
FIG. 4 is a diagrammatic, side view of a printing press having a configuration according to the invention for monitoring the wear of the ink fountain film in a plurality of ink fountains.

Referring now to the figures of the drawing in detail and first, particularly, to FIGS. 1 and 4 thereof, there is shown a detail from a printing press 101, which is depicted in FIG. 4. The detail shows an ink fountain 11 in a printing unit 12. The ink fountain 11 is used to supply an inking unit in an offset printing press with printing ink. The ink fountain 11 normally has a plurality of inking zones, in which there are ink metering elements 3 (FIG. 1). The ink fountain 11 is filled with ink, which has contact with an ink ductor 1. The ink ductor 1 is a roller-like structure which has an electric drive or is driven via mechanical gear mechanisms by other rotating components in the printing unit 12 of the printing press 101. As a result of its rotational movement, the ink ductor 1 conveys ink from the ink fountain 11 into the inking unit of the printing press. The amount of ink which reaches the inking unit depends on how thick the build-up of ink on the ink ductor 1 is. The thickness of the build-up of ink can be determined by the ink metering element 3. In FIG. 1, one of the ink metering elements 3 is depicted and can be moved against the ink ductor 1 as a metering eccentric. Located between the ink metering element 3 and ink ductor 1 is a metering gap 2, which determines the thickness of the application of ink to the ink ductor 1 and therefore the quantity of ink taken off. The larger the metering gap 2, the more ink is picked up by the ink ductor 1. A depth of the ink metering gap 2 may be varied via the ink metering element 3 driven by an electric motor 4. The drive motor 4 drives the ink metering element 3 via a mechanical gear mechanism and it is thus able to move the ink metering element toward or away from the ductor 1. The drive motor 4 is controlled by a motor control system 6. The motor control system 6 is in turn operatively connected to a machine control system 160 of the printing press 101, as can be seen in FIG. 4. Via the machine control system 160, the metering gap 2 can be adjusted electrically by the electric motor 4 and the ink metering element 3 driven by the latter, in order in this way to vary the quantity of ink on the ductor 1. Furthermore, in FIG. 1 it is possible to see an adjusting screw 7, with which the basic distance of the metering element 3 from the ink ductor 1 can be adjusted.

Figure 2A:
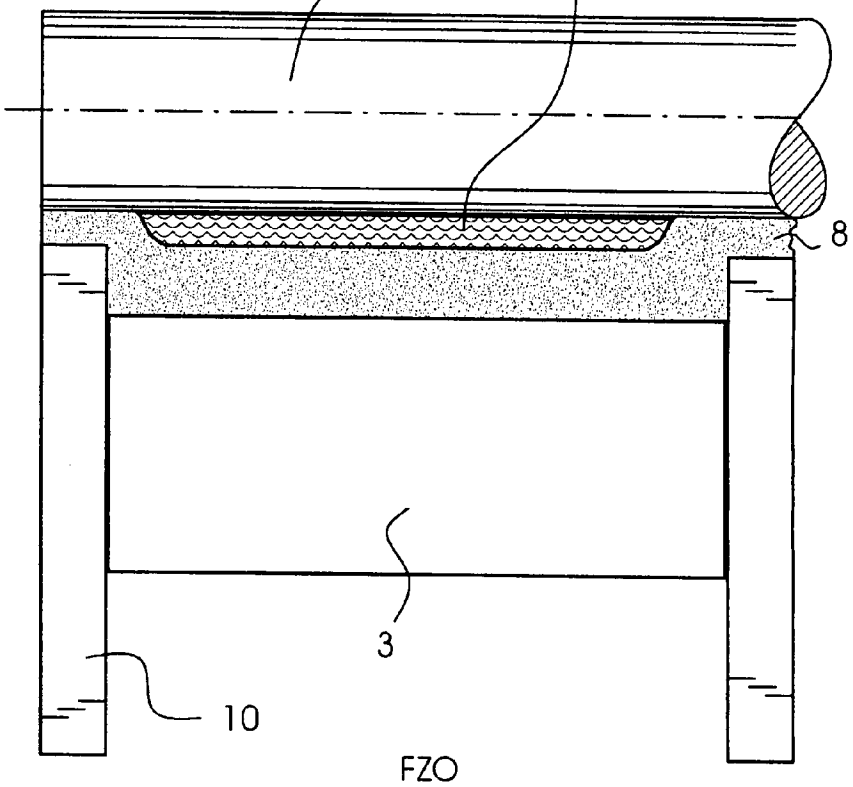
FIG. 2A is a diagrammatic, plan view of the metering gap with a worn ink fountain film.
Figure 2:
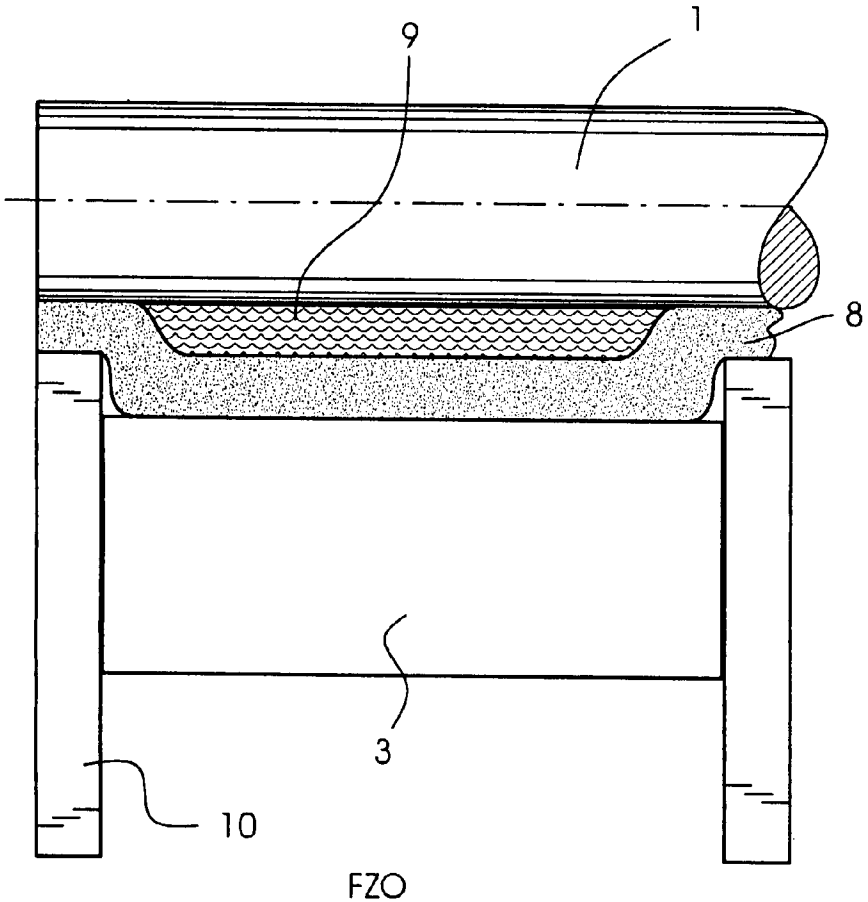
FIG. 2 is a diagrammatic, plan view of a metering gap with a newly inserted ink fountain film.

FIG. 2 shows a plan view from above of the metering gap 2, so that it is possible to see clearly that there is an ink fountain film or foil 8 between the ink ductor 1 and the metering element 3. In FIG. 2, an inking zone FZO in the ink fountain 11 can be seen as a detail and is shown in an open state. In order to open or to close the inking zone FZO, the ink metering element 3 is moved relative to an ink fountain frame 10 of the ink fountain 11. When the inking zone FZO is open, a corresponding ink layer 9 is built up on the ductor roll 1. When the inking zone FZO is closed, no ink is built up on the ductor 1 in the region of the closed ink metering element 3.

As compared with FIG. 2, in FIG. 2A the ink fountain film 8 has already been worn by the operation. The ink fountain film 8 has therefore decreased in thickness, which results in that when the inking zone FZO is open, the application of ink 9 to the ink ductor 1 decreases, since the ink fountain film 8 has lost a considerable amount of thickness in the region of the ink fountain frame 10, so that the ink fountain frame 10 projects closer to the ink ductor 1. If the ink fountain frame 10 were to strike the ductor 1, the latter would be damaged. It is therefore important that the ink fountain film 8 is replaced in good time, so that the ink fountain frame 10 does not strike the ductor 1.

Figure 3:
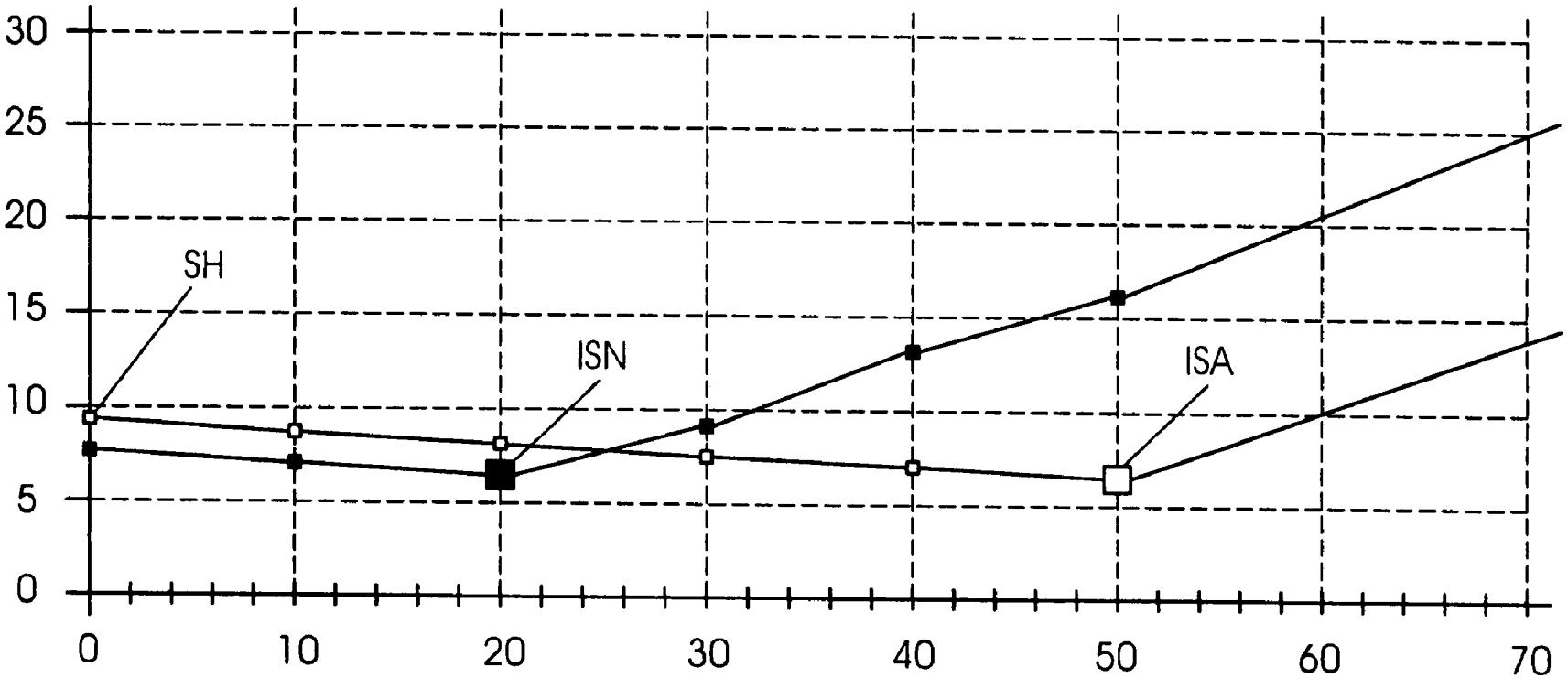
FIG. 3 is a graph showing a width of the metering gap as a function of an inking zone opening and a state of the ink fountain film.

In FIG. 3, the displacement of the closing times as a function of the state of the ink fountain film 8 can be seen as an example. Here, the width of the metering gap 2 in micrometers is plotted against the inking zone opening in diodes. The ideal closing time ISN in the case of a new film is marked in black, while an ideal closing time ISA in the case of an old film is marked in white. The current closing time SH can be seen on the extreme left in the image. For this reason, the ideal closing time is not located at zero diodes of the inking zone opening since, as a result of the overtravel, even with the inking zone FZO completely closed in the region of the ink fountain frame 10, ink is nevertheless applied to the ink ductor 1. In the case of a new ink fountain film, the ideal closing time ISN therefore lies at 20 diodes whereas, in the case of a worn ink fountain film 8, the ideal closing time ISA is displaced toward 50 diodes. In order to make this displacement of the closing time possible, first of all the current closing point SH with a newly inserted ink fountain film must be determined. On this basis, the ideal closing point ISN in the case of a new film is predetermined, by the latter being defined at 20 diodes. Depending on the changes induced by the ink fountain film wear, the ideal closing point is increasingly displaced toward the point ISA. These deviations, occurring during the operation of the printing press 101, can be determined in FIG. 1 by the motor control system 6, by the course of the torque curves or the peaks of the motor current of the motor 4 in the closed position SH being registered with a new film and being related to the deviations occurring during operation. To this end, there is an appropriate sensor in the motor 4 or in the motor control system 6, which registers the motor current or torque. Likewise, the motor rotational speed can be taken as a measure from which the actuating travel can be derived. There is a rotational speed sensor in virtually all electric motors.

According to FIG. 4, the motor control system 6 is connected to the machine control system 160 of the printing press 101. The machine control system 160 controls all the electric motors and electric, hydraulic or pneumatic adjusting elements and other setting devices on the printing press 101. In order to operate the printing press 101, a monitor or display 170 is provided, which is operatively connected to the machine control system 160. On the monitor 170, the operating personnel are able to monitor the state of the printing press 101 and, if appropriate, give corresponding operating commands via an entry device. Via the monitor 170, the state of the metering elements 3 in the individual inking zones of the inking fountains 11 in the printing units 12 can also be detected and set. The state of the ink fountain films 8 in the individual ink fountains 11 can also be illustrated graphically on the monitor 170, so the operating personnel are informed continuously about the state of the ink fountain films 8 and are warned visually or acoustically in the event of no longer permissible wear.

The printing press 101 in FIG. 4 has four printing units 12 and is used for processing sheet printing materials. Of course, however, the present invention can be used in all offset printing presses having zonal ink fountains 11. Each of the printing units 12 has, in addition to an ink fountain 11, an inking unit 16, which supplies the ink removed from the ink fountain 11 to a plate cylinder 13 having the printing plate. From the plate cylinder 13, the printing ink is printed via a blanket cylinder 14 onto a sheet located between blanket cylinder 14 and impression cylinder 15. -The sheet printing materials are separated in a feeder 130 and supplied to the first printing unit 12 via a feeder suction belt 120 and a feeder feed drum 110. The transport between the individual printing units 12 takes place over transfer drums 150, which transport the sheet printing materials through the entire printing press 101. After the last printing unit 12, the finally printed sheet is transferred to the deliverer 140 and stacked there.

In order that the sheet printing material gains the correct inking, the inking zones in the ink fountains 11 in the individual printing units 12 must be opened appropriately. This opening can either be performed by the operating personnel manually via the monitor 170 or can be calculated via an automatic application data transmission in the machine control system 160 of the printing press 101. The number of inking zones and therefore of ink metering elements 3 in the ink fountains 11 depends on the printing format width of the printing press 101. Each ink metering element 3 has an electric drive motor 4, which is in turn connected to a motor control system 6 in each case. This large number of motor control systems 6 is monitored by the-machine control system 160. In FIG. 4, only one motor control system 6 is depicted by way of example. It is technically also possible to monitor a plurality or all of the drive motors 4 by a common motor control system 6.

Figure 5:
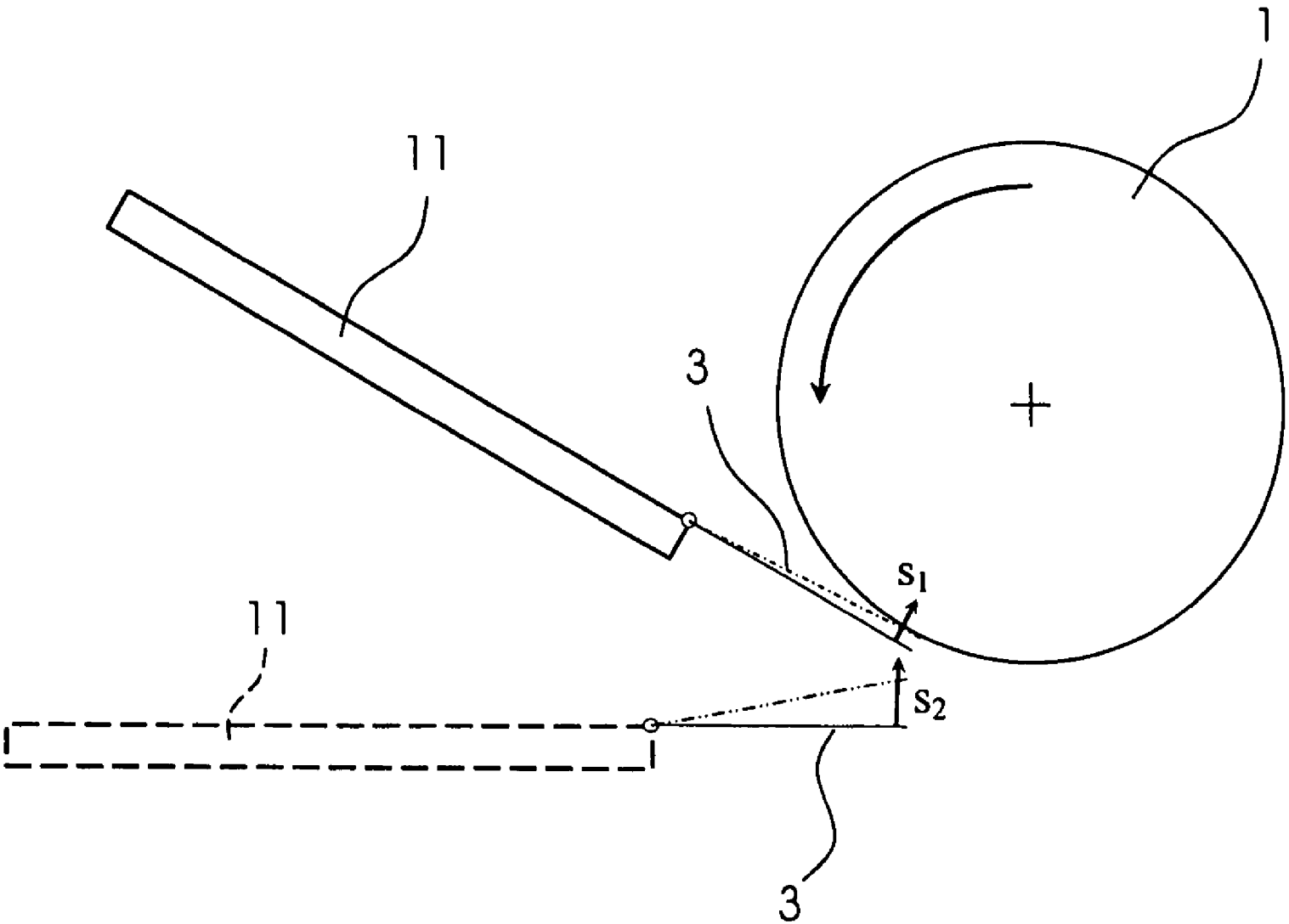
FIG. 5 is an illustration of a device for the detection of the position of the ink fountain in a printing press.

For the functioning of the invention, it is important that, for one or more of the ink metering elements 3, a sensor is provided which monitors the current thickness and therefore the state of wear of the respective ink fountain film 8, either directly or indirectly. This reliably prevents any parts such as the ink fountain frame 10 striking the ink ductor 1 at any time and causing damage there. Such a sensor for registering the thickness of the ink fountain film via the position of the metering element 3 can also be used for the purpose of registering the position of the ink fountain 11 on the printing press 101. This solution is shown by FIG. 5. The ink fountain 11 in FIG. 5 can be folded away from the ink ductor 1, for example for cleaning. This position is illustrated by the dashed lines. During printing operation, on the other hand, the ink fountain 11 is located in the upper position. It can be seen that, with the ink fountain 11 folded away, the maximum movement travel $s_2$ of the metering element 3 is greater than the maximum movement travel $s_1$ when the ink fountain 11 is set on. Therefore, when the ink fountain 11 is folded away, the metering element can be moved beyond the closed position, since the distance between the ink metering element 3 and the ductor 1 is greater. Then, if the ink metering element 3 is moved beyond the closed position into a position which cannot be reached when the ink fountain 11 is set on, this is detected by the computer 160 and it is possible for a signal to be output to the printing press 101 to the effect that the ink fountain has been folded away. This signal is able, for example, to block printing operation as long as the ink fountain 11 is in the folded-away position.

We claim:

1. A device for determining wear of ink fountain films in an ink fountain, the device comprising:

a sensor;

a computer connected to said sensor;

at least one ink metering element; and a ductor, said ductor and said ink metering element disposed in a printing press, said ink metering element can be moved in a direction of said ductor, said sensor configured for determining a closed position of said ink metering element with an ink fountain film inserted, said sensor configured for determining and registering deviations from the closed position and said computer configured for determining the wear of the ink fountain film based on the registered deviations.

2. The device according to claim 1, wherein the deviations from the closed position, registered by said sensor, can be compared in said computer with a given thickness of the ink fountain film.

3. The device according to claim 2, further comprising a display device connected to said computer, the deviations from the closed position, registered by said sensor, being displayed on said display device as a current thickness of the ink fountain film.

4. The device according to claim 2, wherein if the thickness of the ink fountain film falls below a predefined value, a warning signal is generated.

5. The device according to claim 2, further comprising an electric drive motor for moving said ink metering element, a course of a motor current of said electric drive for moving the ink metering element is determined for assisting in determining a current thickness of the ink fountain film.

6. The device according claim 5, wherein for registering a closing point of said ink metering element, a torque of said electric drive motor is registered with said ink metering element closed.

7. The device according claim 5, wherein for registering a closing point of said ink metering element, a rotational speed of said electric drive motor is registered.

8. The device according to claim 1, wherein said ink metering element is one of a plurality of ink metering elements for a plurality of inking zones, it is possible to determine a current thickness of the ink fountain film separately for each of the inking zones.

9. The device according to claim 1, further comprising an adjusting device, a metering gap between said ink metering element and said ductor being set by said adjusting element.

10. The device according to claim 1, wherein a movement of said ink metering element beyond the closed position of said ink metering element can be registered by said sensor.

11. The device according to claim 10, wherein a movement of said ink metering element beyond the closed position of said ink metering element is evaluated by said computer as a signal for the ink fountain being folded away.

12. A printing press, comprising:

an ink fountain having an ink fountain film; and a device for monitoring said ink fountain film, said device including:

a sensor;

a computer connected to said sensor;

at least one ink metering element; and a ductor disposed adjacent said inking fountain, said ink metering element can be moved in a direction of said ductor, said sensor configured for determining a closed position of said ink metering element with said ink fountain film inserted, said sensor configured for determining and and registering deviations from the closed position and said computer configured for determining the wear of the ink fountain film based on the registered deviations.

* * * * *